US007165735B2

(12) United States Patent
Gilbos et al.

(10) Patent No.: US 7,165,735 B2
(45) Date of Patent: Jan. 23, 2007

(54) TWIST PLIED YARN PACKAGE WITH SEGREGATED NODES

(75) Inventors: Erik Gilbos, Dikkelvenne (BE); Christian Van Hautte, Wannegem-Lede (BE); Emiel Rubbrecht, Iddergem (BE)

(73) Assignee: Textielmachinefabriek Gilbos N.V., Herdersem-Aalst (BE)

( * ) Notice: Subject to any disclaimer, the term of this patent is extended or adjusted under 35 U.S.C. 154(b) by 106 days.

(21) Appl. No.: 10/451,506

(22) PCT Filed: Dec. 21, 2001

(86) PCT No.: PCT/EP01/15267

§ 371 (c)(1),
(2), (4) Date: Oct. 10, 2003

(87) PCT Pub. No.: WO02/051736

PCT Pub. Date: Jul. 4, 2002

(65) Prior Publication Data

US 2004/0050031 A1 Mar. 18, 2004

(30) Foreign Application Priority Data

Dec. 22, 2000 (EP) ..... 00870325

(51) Int. Cl.
*B65H 55/04* (2006.01)

(52) U.S. Cl. ..... 242/178

(58) Field of Classification Search ..... 57/293, 57/200, 204, 294; 242/174, 176, 178, 593
See application file for complete search history.

(56) References Cited

U.S. PATENT DOCUMENTS

| | | | | |
|---|---|---|---|---|
| 4,873,821 | A | 10/1989 | Hallam et al. | |
| 5,577,376 | A * | 11/1996 | McAllister et al. | 57/293 |
| 5,644,909 | A * | 7/1997 | Knoff et al. | 57/293 |
| 5,829,241 | A * | 11/1998 | McAllister et al. | 57/204 |

FOREIGN PATENT DOCUMENTS

| | | |
|---|---|---|
| JP | 60 012471 | 1/1985 |
| WO | WO 95/25190 | 9/1995 |

* cited by examiner

*Primary Examiner*—Patrick Mackey
*Assistant Examiner*—William E. Dondero
(74) *Attorney, Agent, or Firm*—Knobbe, Martens, Olson & Bear, LLP

(57) ABSTRACT

A yarn package, provided on a yarn package holder, such as a tube, wherein the yarn is at least partly unstable, such that a variation in the yarn tension results in a rotational movement thereof. The position of the yarn in the yarn package is controlled by the direction of the rotation of the yarn. Also a method for forming a yarn package, wherein the position of the nodes is determined. An apparatus for the production of alternative twist plied yarn and for the formation of a yarn package by winding the alternate twist plied yarn on a yarn package holder, such as a tube, producing alternate twist plied yarn, guiding the alternate twist plied yarn along the longitudinal axis of the package being formed whereby the producing the alternate twist plied yarn is synchronized with the guiding the alternate twist plied yarn along the longitudinal axis of the package.

9 Claims, 4 Drawing Sheets

TWIST PLIED YARN PACKAGE WITH SEGREGATED NODES

RELATED APPLICATIONS

This application is a national phase in the United States of the International Application PCT/EP01/15267 filed Dec. 21, 2001 and claims the benefits of the European Application 00870325.8 filed Dec. 22, 2000 and the U.S. Provisional Application 60/259,657 filed Jan. 3, 2001.

BACKGROUND OF THE INVENTION

1. Field of the Invention

The invention relates to a yarn package provided on a yarn package holder such as a tube, a method for winding a yarn on a tube forming a yarn package and to the yarn package forming apparatus.

2. Description of the Related Art

The intended use of a yarn usually determines the packaging method employed. Package holders consist essentially of for example wood, cardboard, or plastic cores on which yarns are wound, and normally have holes in their centers allowing them to fit on spindles or other holding devices. Several forms and dimensions are available. Spools are cylindrical, with end flanges. Cones, having a conical-shaped core, produce a package of conical shape; tubes, with cylindrical-shaped cores, produce cylindrical packages. Cheeses are cylindrical yarn packages wound on a tube, and, unlike most other packages, they have greater diameter than height. Skeins are coils of yarn wound with no supporting core. Yarn packages are often placed in an unwinding machine such as a creel in an approximately horizontal position.

Yarn is a strand composed of fibers, filaments (individual fibers of extreme length), or other materials, either natural or man-made, suitable for use in the construction of fabrics, such as woven, knitted or tufted types.

In one application the strand may consist of a number of fibers twist plied together; a number of filaments twist plied together; a single twist plied filament, called a monofilament; or one or more twist plied strips made by dividing a sheet of materials, such as paper or metal foil. The properties of the yarn employed greatly influence the appearance, texture, and performance of the completed fabric.

A process and apparatus for making uniform alternate ply-twisted yarn is known from WO 95/25190. This publication describes a process and apparatus for making alternate S and Z twist plied yarn from individual singles yarns including the steps of tensioning the singles yarns as they move in a path through the process, twisting the individual yarns in either an S or Z direction, snubbing the yarn to restrain ply twisting so the twist in the singles yarn can equalize itself, stopping the forward movement of the yarn, then bonding the ply-twisted yarns at a node while applying twist, stopping the twisting operation, then repeating the procedure while twisting in the opposite direction.

Alternate twist plied yarn where the singles strands are twisted in the same direction and are brought together and allowed to spontaneously ply together until the singles twist torque is balanced by the ply twist torque. The single strands are bonded together in the region where the singles twist reverses and they may be bonded in the plied yarn before the singles twist is reversed.

U.S. Pat. No. 4,873,821 describes a process where the alternate ply twisted yarns are bonded in the ply twisted condition before the singles twist is reversed.

Both publications give an example of a twist plied yarn and are hereby incorporated by reference.

More specifically, the twisting action is accomplished by alternate twisting, where for a certain yarn length the yarn is twist plied a number of turns in one direction and then for another sequential length, it is twist plied in the opposite direction. The nature of alternate twisting is such that the total number of turns in one direction minus the total number of turns in the opposite direction over the total yarn-length is zero. The method of taking several twist plied yarns and combining them by twisting them together to make a multi-stranded yarn has been known for years.

Typically, an alternate twist plied yarn shows so called nodes, also denoted as tack zones. These are located in between the S-twist and Z-twist zones or in between the Z-twist and S-twist zones. Nodes or tack zones have substantially zero twist plied; in case of tack zones, the fibers or filaments are e.g. intermingled with each other.

Stable alternate twist plied yarns are known in the art: if one applies tension to the alternate twist plied yarn, this yarn will tend to untwist over the nodes; but when tension decreases, the stable alternate twist plied yarn will twist back to approximately its original twist plied level.

A problem occurring in the prior art with alternate twist plied yarn packages is the fact that these known yarns tend to cause interruptions in the unwinding process, whenever the yarn is rolled off the bobbin for further processing. It has been noticed that they tend to burst or break upon unwinding, or at least show tension peaks in the unwound yarn. This unwanted movement of the yarn is caused by a tension residue within the yarn winded on the bobbin. A release of the yarn will cause a decrease in the tension and provoke a rolling movement of the alternate twist plied yarn. This unwanted behavior may cause interruption and even product failure upon winding.

The invention provides a yarn package wherein this problem is solved.

During winding this yarn on the winder, the yarn winding tension results in an untwisting or detwisting of the yarn on both sides of the nodes. During unwinding, which may occur at low speed, the yarn tension in the yarn decreases. This tension decrease results in a self-twisting rotation of the yarn. When the tension of an alternate twist plied yarn decreases a S-Z node will rotate clockwise for at least several rotations, the reverse will happen at a Z-S node i.e. counter clockwise rotation for several rotations. The intensity of the rotations depends on several different aspects, such as the nature and thickness of the yarn, the twist plied level, etc.

Due to this self-twisting rotational movement of the yarn it might be possible that the yarn rolls to the back off the bobbin and even falls over the edge of the yarn package in the opposite direction of the unwinding direction such that further unwinding becomes impossible. In an unwinding apparatus the yarn tension will become destructive for the yarn, which will ultimately burst. These unwanted situations cause damage not only to the yarn, but harm the total unwinding process, resulting in a loss of production. A repair by knotting the burst ends together is time-consuming and labor intensive work and in general needs to be performed manually.

SUMMARY OF THE INVENTION

In order to overcome this problem a yarn package is provided on a yarn package holder, such as a tube, wherein the yarn is at least partly unstable, such that a variation in the tension of the yarn results in a rotational movement thereof, characterized in that, the position of the nodes in the yarn package is controlled by the direction of the twist of the yarn.

In a preferred embodiment of the yarn package according to the invention the yarn is an alternated twist plied yarn.

In another preferred embodiment of the yarn package according to the invention a decrease in yarn tension results in an anti-clockwise rotation of a Z-S node and in a clockwise rotation of an S-Z node of the yarn.

In another embodiment of the yarn package according to the invention the position of the Z-S node and the position of the S-Z node are determined in the yarn package.

P and Q winding is used for packages which are unwound by pulling the yarn through an unwinding yarn guide and over one specific side of the package.

In case of cylindrical packages with tag-ending, the yarn is always pulled over the opposite side than the tag-end side. During this unwinding, the package stands still, and the yarn being unwound forms a balloon, turning around the package, between the unwinding yarn guide and the package surface.

A P-wound package is a package of which the unwinding balloon is turning in a clockwise direction around the package, if seen from the unwinding yarn guide. If one looks at this package from the unwinding yarn guide, one can make a letter "P" with the loose yarn end combined with the circumference of the package. (see FIG. 2*c*).

A Q-wound package is a package of which the unwinding balloon is turning in a counterclockwise direction around the package, if seen from the unwinding yarn guide. If one looks at this package from the unwinding yarn guide, one can make a letter "Q" with the loose yarn end combined with the circumference of the package.

In another embodiment of the yarn package according to the invention the yarn package has a first end strip and an opposite second end strip, wherein said second end strip comprises the tag-ending, characterized in that, the second end strip is substantially free from Z-S nodes in case of a P-wound package, and substantially free from S-Z nodes in case of a Q-wound package.

In another embodiment of the yarn package according to the invention the first end strip is substantially free from S-Z nodes in case of a P-wound package, and substantially free from Z-S nodes in case of a Q-wound package.

In another embodiment of the yarn package according to the invention the end strips have a width being from 0 to about 60%, preferably 50%, more preferably 40%, 30% or 20% or less than the total width of the yarn package.

In another embodiment of yarn package according to the invention the longitudinal length of the safe strips is 10% or less than the total width of the yarn package.

In a second aspect the invention is related to a method for winding a yarn on the yarn package holder, such as a tube, forming a yarn package, wherein the position of the nodes is being determined.

In a third aspect the invention is related to an apparatus for the production of alternate twist plied yarn and for the formation of a yarn package by winding said alternate twist plied yarn on a yarn package holder, such as a tube, having a means for producing alternate twist plied yarn, a means for guiding the alternate twist plied yarn along the longitudinal axis of the package being formed, characterized in that the means for producing the alternate twist plied yarn is synchronized with the means for guiding the alternate twist plied yarn along the longitudinal axis of the package.

In a preferred embodiment of the apparatus according to the invention one sensor or more than one sensor detect the exact position of the thread guide, and a control means controls the timing of the alternate twist plied process.

In a more preferred embodiment the apparatus according to the invention a sensor on the yarn produced detects the exact position of the nodes in the yarn, and a control means controls the speed and possibly the position of the means for guiding the alternate twist plied yarn along the longitudinal axis of the package being produced.

BRIEF DESCRIPTION OF THE DRAWINGS

With reference to the drawing several embodiments of the invention will be elucidated in detail. In the drawings.

DETAILED DESCRIPTION OF THE INVENTION

In a yarn with alternating twisted plies, nodes occur that form the transition of a piece of S-twist plied yarn to a piece of Z-twist plied yarn and the other way around.

In this description, we accept as a convention that while indicating a piece of yarn, the appellation of the successive pieces of twist occurs in order of winding them onto a package: in case of a S-Z node, a yarn portion with S-twist is wound first, followed by the node itself, followed by a portion of yarn with Z-twist; in case of a Z-S node, a yarn portion with Z-twist is wound first, followed by the node itself, followed by a portion of yarn with S-twist.

We also accept as a convention that we always look at the package whilst it is in a horizontal position with a tag-ending pointing to the right.

Figure 1A:
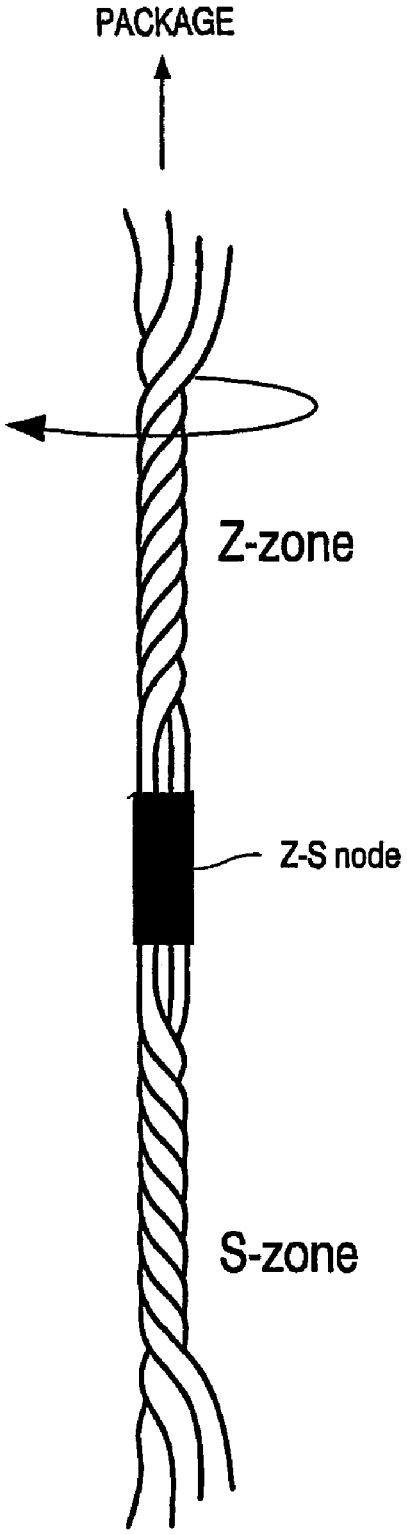
FIG. 1 explains schematically stable alternate twist plied yarns, and their self-twisting action when yarn tension is decreased, FIG. 2 explains the axial movement along the axis of a P-wound package of an alternate twist plied yarn due to the self-twisting action.
Figure 1B:
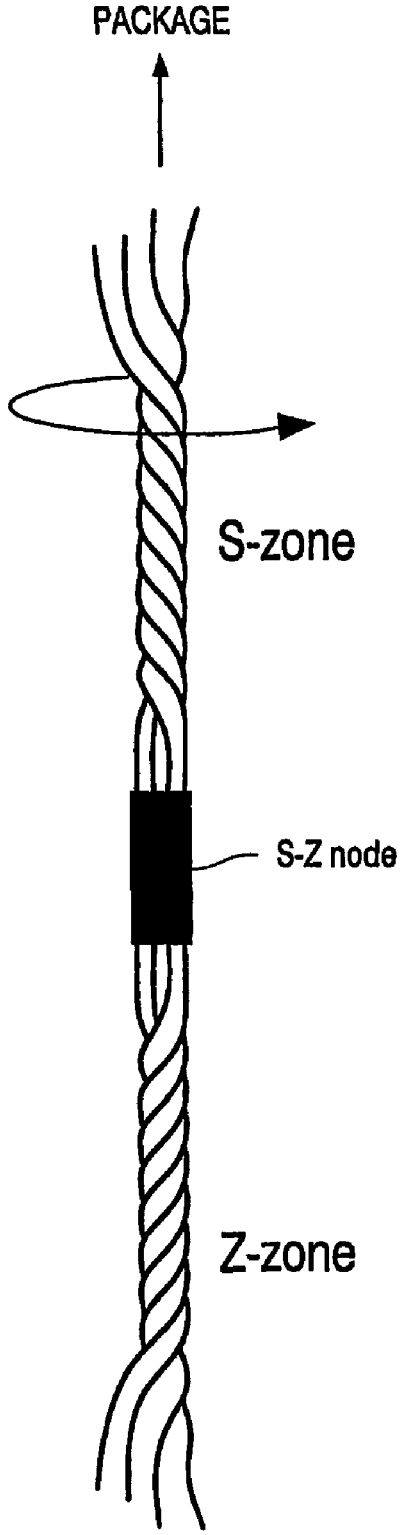

FIGS. 1*a* and 1*b* depict an alternate twist plied yarn. Assume the upper end of the yarn to be connected to the yarn package that is being formed. The upper part of the yarn (FIG. 1*a*) is Z-twist plied, which Z-twist plied zone is followed by an S-twist plied zone with the intermediate of a node wherein the twist is substantially zero. The alternate twist plied yarn of FIG. 1*b* is at the upper part provided with an S-twist plied zone which again is followed by a Z-twist plied zone via a node. The node of FIG. 1*a* is called a Z-S node and as a logical consequence the node of FIG. 1*b* is called an S-Z node.

If such an alternate twist plied yarn is a stabilized alternate twist plied yarn, the twist plied yarn portions will untwist by applying tension to the yarn, but they will twist back to their original twist level when the yarn tension is decreased, by a self-twisting action.

Looking in the direction of the package, this self-twisting of a Z-S node (FIG. 1*a*) will result in a counterclockwise rotation as depicted with circular arrow. As a consequence a decrease of yarn tension in the S-Z node of FIG. 1*b* will result in a clockwise rotation as indicated by the arrow on FIG. 1*b*.

Figure 2A:
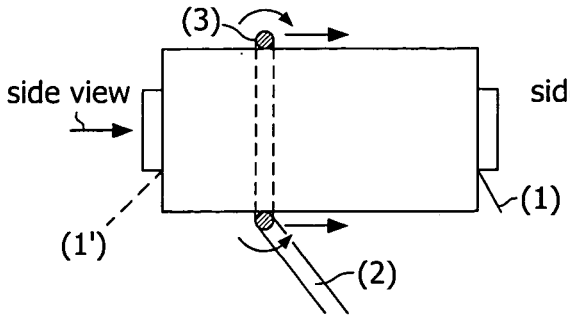
Figure 2B:
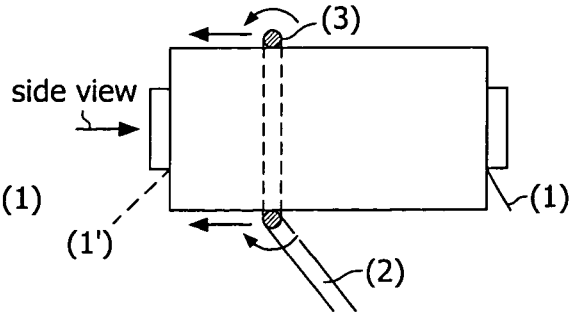

FIGS. 2*a* and 2*b* show a P-wound package in a front view, with the tag-end (1) pointing to the right.

Figure 2C:
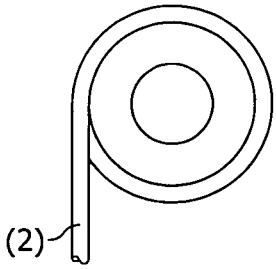
Figure 2D:
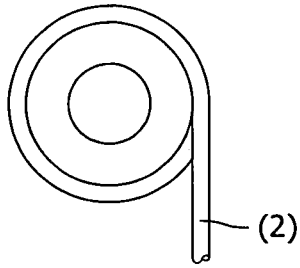

FIG. 2*c* is a side view with the tag-ending (1) at the rear end of the package, whereby the yarn end (2) is being unwound from the package and is the same yarn end over 1800 (3) wound on the package.

In FIG. 2*a* it is shown that the "counterclockwise self-twisting" of the yarn will result in a rolling to the right of a yarn spiral which is wound around the package. In FIG. 2*b* it is shown that the "clockwise self-twisting" of the yarn will result in a rolling to the left of a yarn spiral which is wound around the package.

As a result, a Z-S node tends to roll to the right, while an S-Z node tends to roll to the left, when the yarn tension decreases. This means that a Z-S node can roll off the bobbin on the side of the tag-ending while unwound. The unwinding apparatus will still pull in the opposite direction on this wrongly positioned yarn. The pulling force of the unwinding apparatus will become greater than the tensile strength of the yarn. As a result thereof the yarn will burst and interrupt the overall process.

To avoid fallen off threads and the negative consequences thereof, the nodes must be placed in a well defined position in the yarn package.

The Z-S node in particular needs to be sufficiently far removed from the tag-ending side, such that the rolling movement as a result of the self-twisting of this zone is such that it will not fall off the bobbin. By collecting the nodes in a so-called 'safe zone' the problem is completely solved.

Figure 3:
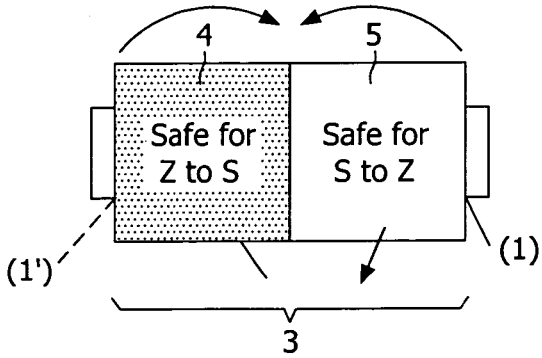
FIGS. 3 and 5 show plan views of preferred embodiments of yarn packages according to the invention.

Therefore, as depicted in FIG. 3 the total width of the P-wound yarn package is divided in a strip 4 which is a strip safe for Z-S nodes and a strip 5 which is safe for S-Z nodes. The rotational arrows indicate the direction in which the yarn will migrate due to a decrease in yarn tension during unwinding.

The same goes for a Q-wound package; in this case, the S-Z nodes need to be sufficiently far removed from the side with the tag-ending.

The desired width of the safe zone depends upon the amount of twist in the yarn. As an example the method of determining the position of the node at the time the yarn is formed with an air twist plied unit is explained in detail. It is self-evident that the following is merely a preferred embodiment. Other node positioning means are also possible in order to obtain the same result, being the positioning of nodes in a yarn package.

In general a yarn is wound on a package by rotating the package while a thread guide traverses the yarn to-and-fro along the longitudinal axis of the package. The position of the node in the yarn has to be synchronized with the movement of the yarn thread guide on the winding apparatus with the intention, whilst winding the yarn, to position substantially all of the nodes in a 'safe zone' in the yarn package.

The most simple execution of this solution can be used for yarns of which the S and Z twist plied zones are of equal length, and of which the nodes are always placed at the same longitudinal place on the package. The air twist plied unit which produces the yarn, no longer has a free choice as for the length of the S and Z twist plied zones. The length of S and Z twist plied zones will be determined by the angle of wind, in combination with the width (or traverse length) of the package being formed, and is independent of the diameter of the package as well as of the winding speed.

In a preferred embodiment the yarn angle of wind is not constant, but varies, to avoid a ribbon effect, preferably about 30 times per minute going up 3–10%, for example 6% and going down 3–10%, for example 6%.

The consequence of this variation is that the nodes will not always be placed at the same place on the bobbin, but will be divided over a zone of approximately 3 to 10% in our example 6% of the width of the bobbin.

Figure 4A:
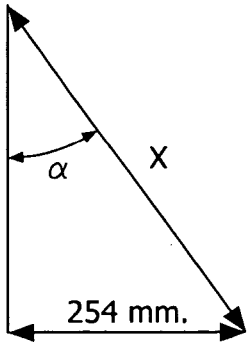
FIG. 4 is a graph indicating how the length of a S-twist portion respectively a Z-twist portion of yarn may vary with the winding angle.

A practical example is elucidated schematically in FIG. 4*a*.

X is the length yarn being wound on the bobbin after one stroke (e.g. 254 mm) of the yarn thread guide. The horizontal component denotes the speed of the yarn thread guide; the vertical component is tangential speed of the package. Different angles αwill result in different lengths X, due to the equation $X$=(width of the package e.g. 254 *mm*)/sin α. Several examples are included in table 1.

TABLE 1

| Angle of winding α [°] | X [mm] |
|---|---|
| 13 | 1129 |
| 15.4 | 956 |
| 17 | 869 |
| 19.5 | 761 |
| 22 | 678 |

To produce yarn with a fix and equal length for the S and Z twist plied zones, of which the nodes in addition always are positioned in the safe zone, one can choose e.g. between zones with a length 2*X, X or X/2.

Hereunder five different embodiments indicating safe zones or safe strips having a certain width are exemplified.

Figure 5A:
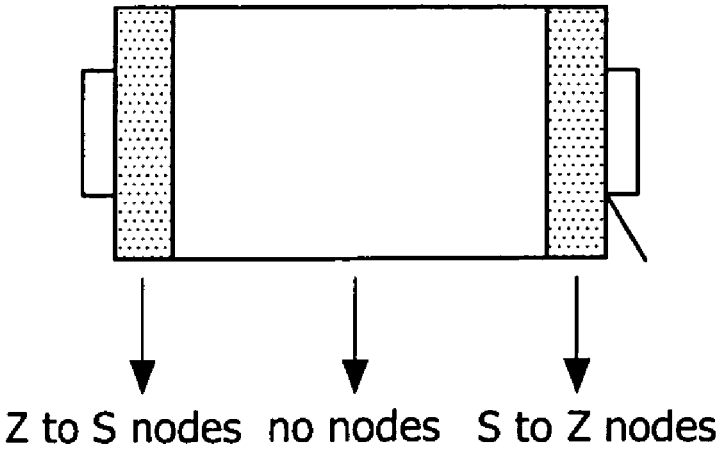
Figure 5B:
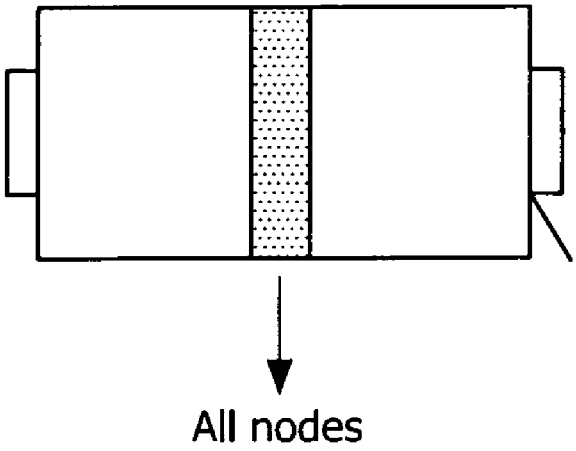

If the twist plied zones have a length X, the resulting yarn package is schematically depicted in FIG. 5*a* or 5*b*.

Preferably the width of these strips is minimal, but all widths which satisfy the requirement of not "falling off" are allowed.

The hereunder following description relates to an embodiment of the apparatus that is able to produce a bobbin according to the invention, more in particular a bobbin according to FIG. 5*a*, wherein essentially all the Z-S nodes are positioned on the left side and will roll when released to the right, and wherein essentially all the S-Z nodes lay on the right side on the bobbin and upon release will and roll to the left. Both node or back parts of the yarn will shift to the middle when the tensile stress within the yarn is diminished upon unwinding.

Several sensors may be provided on a known yarn conducting system able to produce said bobbin. In an embodiment according to the invention two sensors are placed on the yarn conducting system. A first sensor ($sensor_{zs}$) may generate a pulse on the moment the conducting arm is at the left rotation position; a second sensor ($sensor_{sz}$) may generate a pulse on the moment the conducting arm is at the right rotation point.

In this particular case the yarn conducting system is acting as a back and forth going conducting arm. A similar reasoning is valid in the case that a grooved drum would conduct the yarn. The sensors may be connected on a printed circuit board able to control the valves of an air twist plied system, said system is able to fixate the nodes by means of a pressure-controlled pulse. Air twist plied systems as such are known in the art and consist essentially of a hollow tube where through the twist plied yarn is fixated through the action of pressurized air acting in regular pulses on the node or tack positions on the twist plied yarn. Such a pressure pulse on the node or tack is normally sufficient to provide a fixation of the nodes in the yarn. Of importance is a precise control of the valves in time, such that a pulse is allowed on each back.

Figure 6:
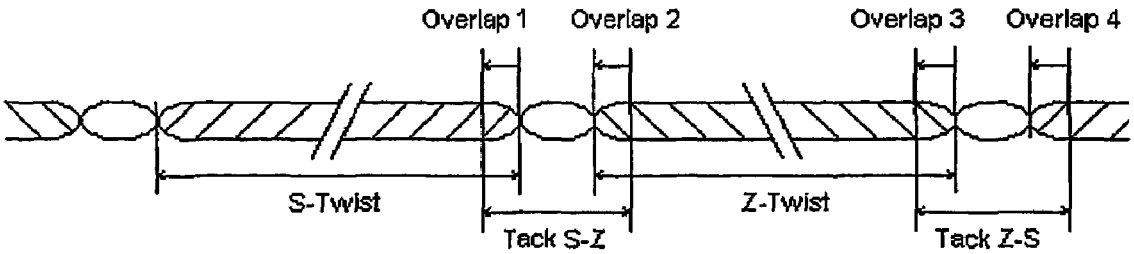
FIG. 6 is a cross-sectional view of an embodiment of an alternate twist plied yarn according to the invention.

In an embodiment to produce air twist plied yarns three valves are sufficient, one valve to fixate the tack zones T, one for provoking S-twist (S) and one for provoking Z-twist (Z) in the threads of the yarn. These three valves are in general rhythmically steered by a PCB in a required order, e. g. S-T-Z-T-S-T-Z-T etc., whereby short overlays may occur so that in the transition zones two valves can be active at the same time. The transitions S-T-Z and Z-T-S are completely independently adjustable via a set of parameters. Different yarn types require in general different transitions to come to a solid tack zone. FIG. 6 schematically discloses an example of such a twist plied yarn. As clock signal for the transitions, a pulse train may be used of which each pulse matches with a predetermined length, for example 5 mm of yarn. By working on length-base instead of time base, the adjustment of the parameter is not dependent on the chosen velocity and. the transitions stay identical during the driving on and off of the system.

The length of the S-twist and the Z-twist zones are not adjustable and depend merely on the frequency of the pulse train that is normally generated by the yarn conducting system.

The control of the PCB decides to make a tack and to rotate the sense of the twist each time it receives a pulse of one of the two sensors of the yarn conducting system. When a pulse of the sensors is received, the PCB activates the T valve for a short while and afterwards the S valve. When a pulse of the sensors, is received, the PCB activates the T valve for a short while and afterwards the Z valve.

The forced adaptation however does not occur immediately, but in general with a time and length delay. This delay is adjustable via above-mentioned parameters. By the tack control, the tack zones always lay within a restricted zone, but these zones do not lay automatically at the (good) side of the bobbin. By slowing down the pulses of the sensors on the PCB (otherwise said building in a delay between the reception of the pulse and the start of the therewith associated action) it is possible to move the tack zones on the bobbin.

The length of the delay, necessary to place the zones with tack zones at the good side of the bobbin, depends on the distance between the air twist plied system and the winder and on the length of the twist plied zones (determined by the yarn conducting angle of the winding system). All these parameters are adjustable and controllable such that a bobbin according to the invention is produced.

The influence of anti-ribbon on the width of the zones with tack zones is discussed hereunder.

In actual practice, the yarn conducting angle is generally not constant, but varies to avoid image winding approximately 30 times per minute between about 6% upwards and about 6% downwards. This implies that the length of the twist plied zones varies continuously between 254/sin ($\alpha$−6%) and 254/sin ($\alpha$+6%) whereby a is the average conducting angle.

Due to the position of the tack zones produced in the air twist plied unit at a few meters of the winder, it might be possible that due to the non-constant length of the twist plied zones, a spread of the tack zones over a wide zone is obtained. This zone can not be acceptable, so that preferably additional measures are taken.

To avoid above-mentioned phenomena, it is advantageous that the winder performs exactly one complete period of the anti-ribbon each time a length of yarn was developed, equal to the distance of the yarn course between the place where the tack is made and the point where the yarn actually comes on the bobbin (the yarn course length).

In actual practice, this may be achieved or by adjusting the distance between the air twist plied unit and the winder, or by adjusting the period of the anti-ribbon. The layout of the installation is however in general not easily modifiable, so that the most efficient way to solve this problem is to adjust the period of the anti ribbon work. On the most simple embodiment of winders, the anti-ribbon is driven by the same engine as the drive-cylinder on which the bobbin is attached, so that the period of the anti-ribbon varies when the velocity changes.

For mechanical reasons (inertia, usage, . . . ) the period must preferably be sufficiently long. An alternative embodiment whereby the yarn conduction is driven through a separate engine, unrelated to the tangential drive of the bobbin, may also be used. In this case the period of the anti-ribbon is calculated based on the yarn course length and the winding velocity, and the period can be extended if the winder is used for an other application with a high winding velocity.

A possible method for the production of a yarn package according to the invention is to synchronize the formation of a node with the movement of the yarn thread guide. Therefore, at least one reference signal is generated from the position of the yarn thread guide along the longitudinal axis of the package, and this signal is then used as trigger for the synchronization.

Variations are possible, such as generating a signal from the drive system of the thread guide instead of from the thread guide itself; it is also possible to generate two or more signals from the thread guide or its drive system in order to trigger separately the formation of Z-S and S-Z nodes, or to trigger the formation of nodes which will be wound on different places along the longitudinal axis of the package.

For correct synchronization, also the distance along the yarn path has to be considered between the place where the node is made—for example on the air twist plied unit—and the place where the yarn thread guide places the yarn on the package. This distance divided by the yarn speed determines a phase shifting in the time-synchronization of the generation of one or more reference signals on one hand, and of the formation of nodes on the other hand.

The invention claimed is:

1. A yarn package provided on a yarn package holder, wherein the yarn comprises S-twist and Z-twist portions with S-Z or Z-S nodes interposed inbetween, such that a variation in the yarn tension during unwinding from the yarn package holder results in a self-twisting rotational movement thereof, wherein the position of the S-Z nodes and the Z-S nodes in the yarn package is controlled during winding based on the self-twisting rotational movement of the yarn.

2. A yarn package according to claim 1, wherein a decrease in yarn tension results in an anti-clockwise rotation of the Z-S nodes and in a clockwise rotation of the S-Z nodes in the yarn.

3. A yarn package according to claim 1, wherein the yarn package is a P-wound yarn package having a first end strip and an opposite second end strip, wherein said second end strip comprises a tag-ending, characterized in that, the second end strip is substantially free from Z-S nodes.

4. A yarn package according to claim 3, wherein the first end strip is substantially free from S-Z nodes.

5. A yarn package according to claim 3, wherein the first or second end strip has a non-zero width of 60% or less, of the total width of the yarn package.

6. A yarn package according to claim 5, wherein the width of the first or second end strip is 10% or less of the total width of the yarn package.

7. A yarn package according to claim 1, wherein the yarn package is a Q-wound yarn package having a first end strip and an opposite second end strip, wherein said second end strip comprises a tag-ending, characterized in that, the second end strip is substantially free from S-Z nodes.

8. A yarn package according to claim 7, wherein the first end strip is substantially free from Z-S nodes.

9. A yarn package according to claim 1, wherein the position of the S-Z nodes and the Z-S nodes in the yarn package is limited to a determined safe zone for the S-Z nodes and a safe zone for the Z-S nodes.

* * * * *

UNITED STATES PATENT AND TRADEMARK OFFICE

CERTIFICATE OF CORRECTION

PATENT NO. : 7,165,735 B2
APPLICATION NO. : 10/451506
DATED : January 23, 2007
INVENTOR(S) : Gilbos et al.

It is certified that error appears in the above-identified patent and that said Letters Patent is hereby corrected as shown below:

Column 5, Line 10, "1800 (3) wound" should be changed to --180° (3) wound--

Column 6, Line 13, "X is the length yarn" should be changed to --X is the length of yarn--

Column 6, Line 17, "Different angles αwill" should be changed to --Different angles α will--

Column 7, Line 25, "and. the transitions" should be changed to --and the transitions--

Column 7, Line 62, "whereby a is the average" should be changed to --whereby α is the average--

Column 8, Line 53, "nodes interposed inbetween," should be changed to --nodes interposed in between--

Signed and Sealed this

Twenty-fifth Day of December, 2007

JON W. DUDAS
*Director of the United States Patent and Trademark Office*